United States Patent [19]

Ford

[11] Patent Number: 4,573,710

[45] Date of Patent: Mar. 4, 1986

[54] SNOW SCRAPER FOR SKI BOOTS

[76] Inventor: Ronald R. Ford, 312 Laurent St., Santa Cruz, Calif. 95060

[21] Appl. No.: 205,101

[22] Filed: Nov. 10, 1980

[51] Int. Cl.[4] ..... A63C 11/22

[52] U.S. Cl. ..... 280/813

[58] Field of Search ..... 280/813, 816, 819, 809; 15/237, 112; 135/66, 65

[56] References Cited

U.S. PATENT DOCUMENTS

| | | | |
|---|---|---|---|
| 1,396,702 | 11/1921 | Von Hoffmann | 15/237 |
| 3,284,091 | 11/1966 | Spier | 280/11.13 |
| 3,929,345 | 12/1975 | Nasby et al. | 280/813 |
| 4,145,062 | 3/1979 | Stiemert | 280/813 |
| 4,221,393 | 9/1980 | Donahue | 280/813 |

FOREIGN PATENT DOCUMENTS

| | | | |
|---|---|---|---|
| 60822 | 8/1913 | Austria . | |
| 225050 | 12/1909 | Fed. Rep. of Germany . | |
| 2355748 | 5/1975 | Fed. Rep. of Germany . | |
| 2601348 | 7/1977 | Fed. Rep. of Germany . | |
| 1150548 | 5/1956 | France . | |
| 1285357 | 1/1962 | France . | |
| 37247 | 8/1921 | Norway | 280/813 |
| 56137 | 2/1936 | Norway . | |
| 69611 | 10/1945 | Norway . | |
| 50842 | 1/1910 | Switzerland . | |
| 117129 | 10/1926 | Switzerland . | |

*Primary Examiner*—David M. Mitchell

*Attorney, Agent, or Firm*—Jack M. Wiseman

[57] ABSTRACT

A scraper for cleaning packed snow and the like from the sole of ski boots includes a tubular member that is adapted to be carried on the shaft of a ski pole at a point spaced from the basketed end of the pole. The scraper is a generally tubular member provided with a plurality of outwardly projecting fins or blades which are adapted to remove snow from the boot.

3 Claims, 6 Drawing Figures

Fig. 1
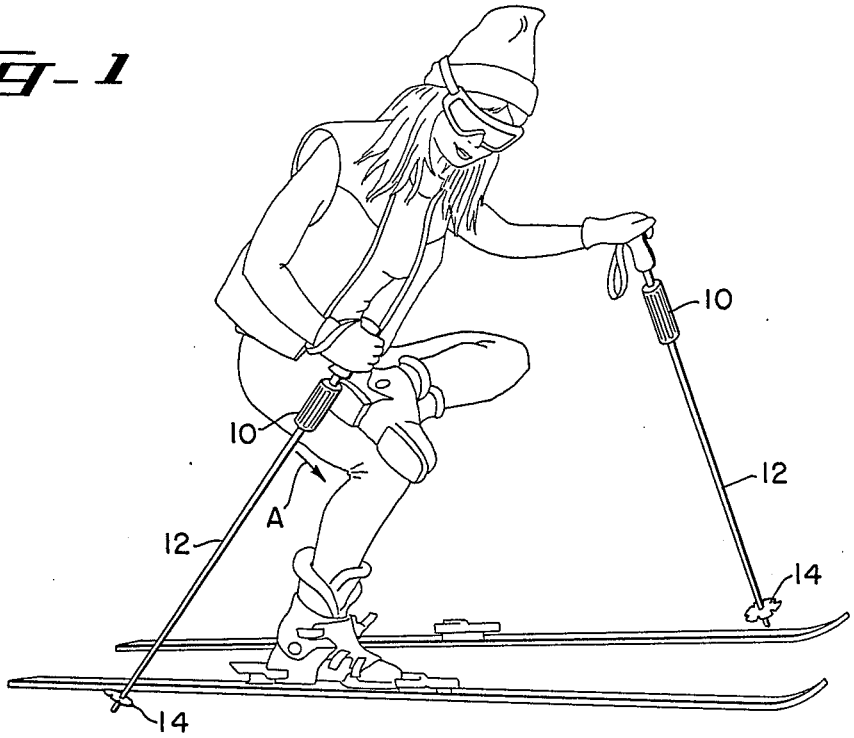
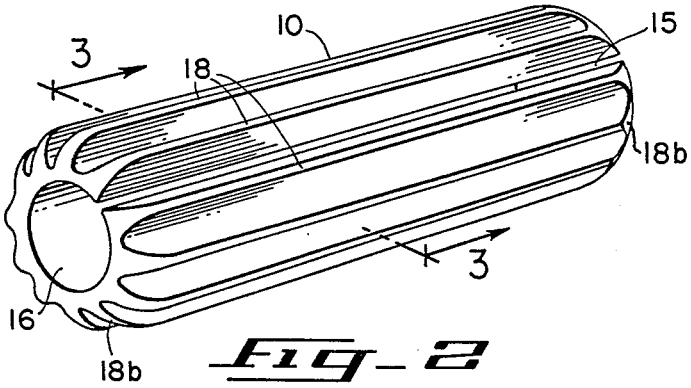
Fig. 2
Fig. 3
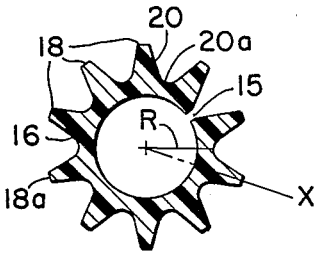
Fig. 4
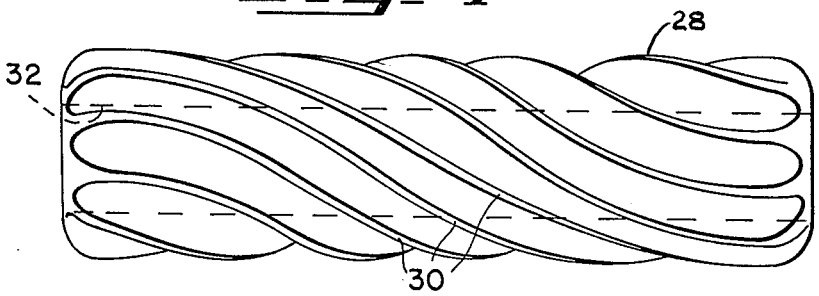

SNOW SCRAPER FOR SKI BOOTS

BACKGROUND OF THE INVENTION

The present invention relates to scrapers and more particularly concerns a snow scraper adapted to be carried on a ski pole.

Several situations arise during a skiing outing when snow might accumulate and become caked on the sole of a skier's boot. For example, it may be desirable or necessary to walk to the top of a hill or to a place where the skis can be put on. In sutuations where snow does become packed on the sole of a boot, it must be removed before the boot can be properly inserted in the ski binding. Different devices, such as knives and hand scrapers have been proposed for this operation. Small portable scrapers have the inherent disadvantage of requiring continuous transporting, and or constantly being misplaced or causing injury to the skier if he should fall while carrying it in a pocket. Accordingly, several scrapers have been proposed that are adapted for mounting on a ski pole so that they can be conveniently carried by the skier and always be available when needed. One type of pole-carried scraper is disclosed in the patents to Sahlein et al., U.S. Pat. No. 3,350,111 and Knapp et al., U.S. Pat. No. 4,145,063. This type involves, in general, a semi-cylindrical member that is arranged to be clamped on the shaft of a pole in pivoting relation for movement from a retracted position, in which the semi-cylindrical scraper lies longitudinally on the shaft with the shaft partially enclosed by the scraper, to an extended position at right angles to the pole on which the scraper presents edges over which the boot may be drawn. Another type of pole-carried scraper is disclosed in U.S. Pat. Nos. 3,929,345, 4,000,909, and 4,145,062 and Norwegian Pat. No. 78,501, each of which concerns scrapers that are cylindrical or partially cylindrical in configuration, and are positioned longitudinally along the shaft of the pole, being integrally formed with the pole, or clamped or secured thereon.

SUMMARY OF THE INVENTION

The scraper of the present invention is a generally tubular member whose inside diameter is approximately the same as the outside diameter of the shaft of the ski pole, and the scraper is thus adapted to be positioned on the shaft in generally concentric relation. Scraping blades are formed on the exterior surface of the tubular scraper to project generally radially outwardly therefrom. In one embodiment the blades are disposed in a spiral pattern which promotes self-cleaning of the blades. Another feature of the invention is the provision of a slot along one side of the member so that the scraper can be positioned by moving it laterally over the shaft after temporarily expanding the slot. A further feature is the provision of a scraper that is retained on the shaft by a press fit.

DESCRIPTION OF THE DRAWINGS

FIG. 1 is an illustration of a skier using ski poles having scrapers thereon which are constructed according to the teaching of the present invention.

FIG. 2 is an isometric of one embodiment of the scraper of the present invention.

FIG. 3 is a section taken along line 3—3 of FIG. 2.

FIG. 4 is a side elevation of a second embodiment of the scraper.

DESCRIPTION OF A PREFERRED EMBODIMENT

Figure 5:
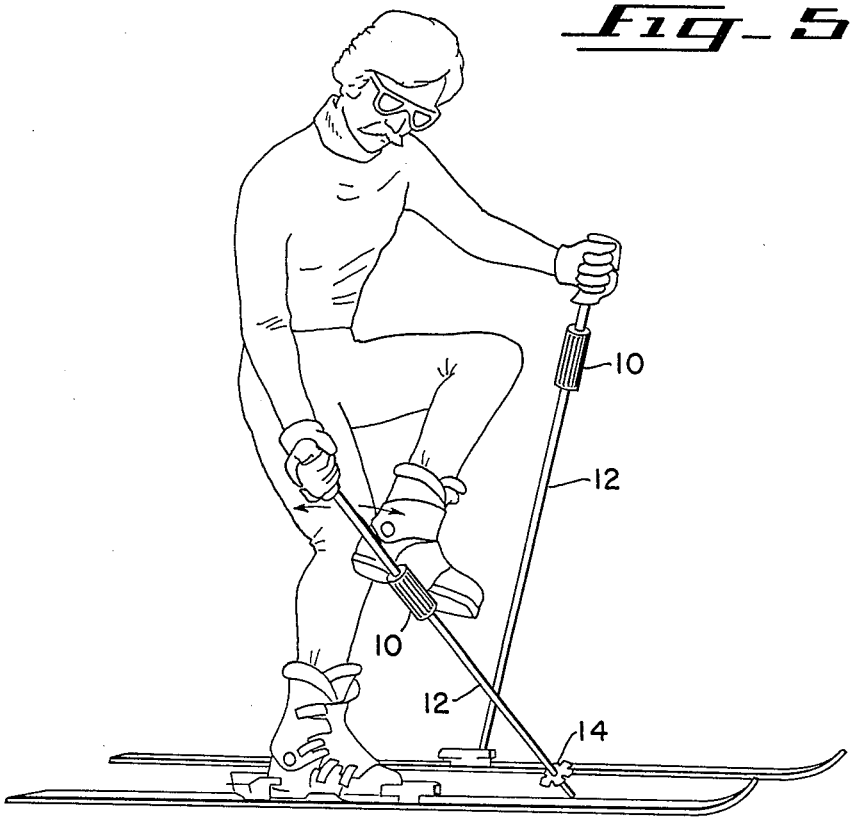
FIGS. 5 and 6 are views illustrating two different methods of using the scraper when it is positioned at different locations on a pole.

In FIG. 1 the reference numerals 10 indicates scrapers, made according to the teaching of the present invention, disposed on ski poles 12 at points spaced from the basketed ends 14 of the poles and adjacent the hand grips of the pole. In FIG. 2 it will be seen that each scraper 10 is an elongate tubular member having a slot 15 extending entirely through a wall of the tube and extending for the full length of the tube. The scraper has a central body portion 16 (FIG. 3) from which a plurality of generally radially projecting blades 18 extend. The blades are spaced apart to form grooves 20, each of which has a curved bottom 20*a*. As best seen in FIGS. 2 and 3, the blades are widest near their base and taper inwardly to a relatively thin upper portion with flattened top surfaces. It will be noted that in a preferred embodiment the blades are not tapered to a sharp outer edge but, rather, they have a narrow planar outer surface 18*a* oriented tangentially to a circle whose radius is equal to the distance that a point, which is on the surface and in the central longitudinal radial plane "X" (FIG. 3) of a blade, is from the axis of the tube. The blades have rounded edges 18*b* (FIG. 2) at each end to prevent injury to the skier during a fall. The curved concave surface at the bottom of each groove is effective to re-direct material that is forced down in the groove and send it outwardly of the blades.

In FIG. 1 one manner of using the scraper 10 is shown. It should be noted that the position adapted by the skier for this operation is a stable three-point stance defined by the skier's two ski poles firmly planted in the snow on either side of the skier, one slightly behind him and one opposite the foot he is standing on. With the tip of the pole engaging the ground, the skier moves the scraper in the direction of arrow A, the pole acting as a long lever enabling the skier to apply a significant amount of force with the scraper to the boot sole to dislodge snow and the like from the sole.

If the scraper is moved downward on the pole to a position near the longitudinal center of the pole, the pole tends to vibrate during the snow scraping operation. This vibrating action causes the snow particles to be dislodged from the scraper in a self-cleaning action. FIG. 5 illustrates one manner in which the scraper can be used when it is positioned near the longitudinal center of the pole.

Figure 6:
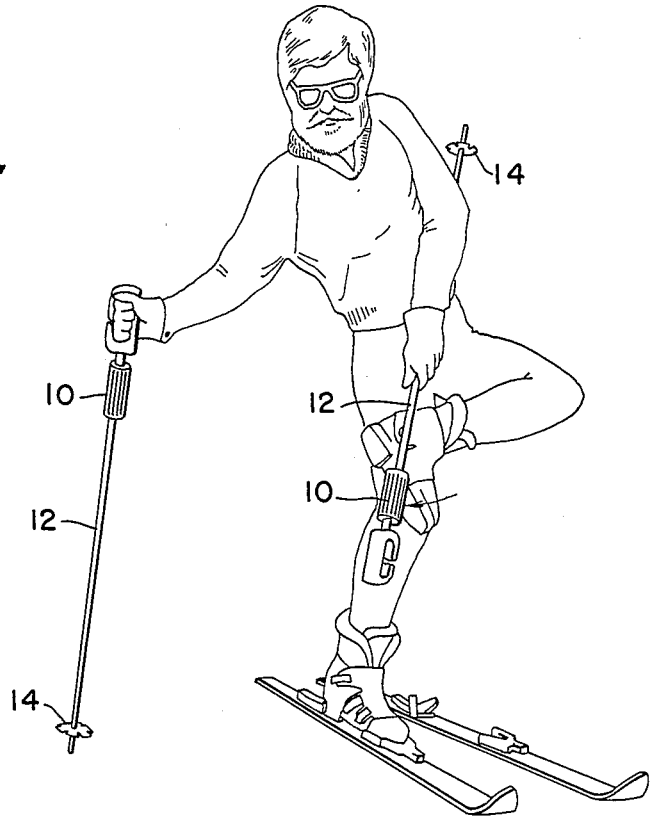

FIG. 6 illustrates a method of using the scraper by imparting short swinging blows to the ice or snow to knock it from the sole of the boot. To carry out this boot-cleaning action, the scraper 10 may be positioned near the longitudinal center of the pole or near the outer end of the pole. The position of the scraper on the pole and the stance assumed by the skier will vary. The only requirement is that the skier have a relative stable stance and the ability to impart short blows against the boot while keeping the scraper somewhat parallel to the sole of the boot, thus ensuring effective use of the edges of the scraper.

A feature of the present invention is the fact that the blades of the scrapers of this invention are relatively short in radial direction. Thus, during a scraping operation, the moment arm at which the force is applied by the outermost scraping edge is kept to a minimum and therefore the force tending to rotate the scraper and cause an ineffective scraping action is relatively low. In one embodiment, designed for use on an aluminum pole that is approximately ¾ inches in diameter, the scraper was provided with a central bore of about ¾ inch, the radial distance from the center of the bore to the base of the groove at 20*a* (FIG. 3) was about 15/32 inch, and the radial distance to the scraping surface was about ⅝ inch. The effective height of each blade was therefore approximately 5/32 inches. In a scraper adapted for use on a pole used by a child and having a diameter of ½ inch, the above dimensions will be decreased.

In FIG. 4 an embodiment 28 of the present invention is shown wherein a plurality of blades 30 are formed to project outwardly from a central tubular body which has a longitudinal bore 32 therethrough. This scraper differs from the scraper 10 of FIG. 2 in that, while the blades 30 have substantially the same tapered contour as the blades 18, the blades 30 are arranged in a spiral pattern. During the snow-scraping operation, the spiral arrangement tends to eject the snow from the grooves between the blades and thus the scraper blades 30 have an effective self-cleaning action.

The scraper 10 is installed on a ski pole, by positioning the scraper alongside and generally parallel to the pole with the slot 15 adjacent to the pole, and then urging the scraper toward the pole as by a sharp blow with the hand. This causes the slot to open up and allow the edges of the scraper on each side of the slot to ride over the pole. The material of the scraper will permit this slot-opening action and will also urge the slot to its original substantially closed position as soon as the scraper has moved inwardly over the pole a sufficient distance to permit the closing movement. It will be noted in FIG. 3 that the walls of the scraper blades on each side of the slot 15 diverge outwardly away from each other to facilitate the initial entry of the pole in the slot. The scraper is then slid along the pole to the position the user finds to be most effective for the type of scraping operation he finds to be most effective for him.

It is desirable that the scraper does not rotate on the shaft during the scraping action. In one embodiment where the plastic scraper was formed of polycarbonate and the inner diameter of the scraper was made of 0.050 inches less than the diameter of the aluminum pole, the frictional grip of the scraper on the pole effectively resisted rotation of the scraper. If a scraper is installed on a pole during the manufacturing of the pole, the inner diameter of the scraper can be so chosen that, when the scraper is forced onto the pole by suitable machinery, it will have a "press-fit" engagement with the pole and rotation of the scraper on the pole will be effectively prevented. This "press-fit" embodiment preferably does not have a longitudinal slot and is installed on the pole by moving it endwise onto one end of the pole when the ski pole basket is not in position.

The scrapers 10 and 28 are made of plastic. A polycarbonate plastic has been found to have a coefficient of friction, when in contact with the aluminum pole, adequate for resisting rotation of the scraper relative to the pole. Other plastics, may be used for the scrapers to obtain the desired frictional gripping of the pole.

From the foregoing discussion, it will be apparent that the present invention provides a snow scraper that is light in weight and does not interfere with the normal operation of the ski pole. The provision of flat, tangential surfaces at the outer edges of the blades results in very effective scraping edges being formed, and the rounded surface at the base of each groove is uniquely adapted for intercepting the scrapings and redirecting them out of the groove to provide a self-cleaning action for the scraper.

I claim as my invention:

1. A scraper adapted to be mounted on a ski pole comprising a body portion having a central passage therethrough adapted to receive the pole, and a plurality of blades projecting outwardly from said body portion, each blade extending longitudinally along and about said body portion in a spiral configuration.

2. The scraper of claim 1 wherein said body portion is a cylindrical member having a bore therethrough and the bore of said body portion is dimensioned so that said body portion may be mounted with a press-fit on a pole.

3. A scraper adapted to be mounted on a ski pole comprising a generally tubular body portion having a longitudinal passage arranged to receive the pole, and at least one blade extending longitudinally about and outwardly from said body portion in a spiral configuration.

* * * * *